United States Patent [19]

Tsumura et al.

[11] Patent Number: 4,708,505

[45] Date of Patent: Nov. 24, 1987

[54] TYPEWRITER MISPRINT CORRECTION METHOD

[75] Inventors: Takeo Tsumura, Matsubara; Hiroji Iwai, Yamatokoriyama; Atsushi Kadoya, Kitakatsuragi, all of Japan

[73] Assignee: Sharp Kabushiki Kaisha, Osaka, Japan

[21] Appl. No.: 801,584

[22] Filed: Nov. 25, 1985

[30] Foreign Application Priority Data

Nov. 27, 1984 [JP] Japan ..... 59-250997
Nov. 27, 1984 [JP] Japan ..... 59-250998

[51] Int. Cl.[4] ..... B41J 29/34; B41J 33/36
[52] U.S. Cl. ..... 400/697.1; 400/232
[58] Field of Search ..... 400/697, 697.1, 229, 400/226, 232

[56] References Cited

U.S. PATENT DOCUMENTS 3,613,857 10/1971 Thevis et al. ..... 400/226
4,307,971 12/1981 Kane, III et al. ..... 400/697
4,388,005 6/1983 Wehking et al. ..... 400/697

FOREIGN PATENT DOCUMENTS 102474 3/1984 European Pat. Off. ..... 400/232
56883 4/1983 Japan ..... 400/697.1
158286 9/1983 Japan ..... 400/232
194593 11/1983 Japan ..... 400/232

OTHER PUBLICATIONS

Hagiwara, "Variable Speed . . . Mechanism", IBM Technical Disclosure Bulletin, vol. 24, No. 11B, pp. 6112–6113, 4–82.

*Primary Examiner*—William Pieprz
*Attorney, Agent, or Firm*—Birch, Stewart, Kolasch & Birch

[57] ABSTRACT

A typewriter misprint correction method in which misprint is completely erased when ink is lifted from the paper by erasing impressions through correction tape, erasing impression being conducted two or more times for each character and a prescribed length of correction tape being fed after at least one erasing impressions.

6 Claims, 10 Drawing Figures

TYPEWRITER MISPRINT CORRECTION METHOD

BACKGROUND OF THE INVENTION

The present invention relates to a typewriter misprint correction method.

Typewriter carriages with a print erasing function are provided with a typing head, a printing ink ribbon, and an adhesive correction tape. To print, the ink ribbon is shifted up to printing position, and a type is impressed on the paper through the ink ribbon. The carriage moves one character to the right (spacing) for each type impression. To correct a misprint, the carriage is moved back to the left (backspacing) to misprint position. The correction tape is then shifted up to printing position, and the misprint type is selected and impressed on the paper through the correction tape. Misprint ink is thus lifted from the papar on to the adhesive surface of the correction tape, erasing the misprint.

In such a correcting operation, it is difficult to precisely match the erasing impression position with the misprint. In some cases, sections of the misprint may be left unerased due to positioning error.

SUMMARY OF THE INVENTION

In view of the foregoing, it is an object of the present invention to provide a typewriter misprint correction method in which a misprint is completely erased by two or more erasing impressions.

Another object of the present invention is to provide a typewriter misprint correction method in which a prescribed length of correction tape is fed after the initial erasing impression to avoid ink transfer from the correction tape to the paper for complete misprint erasure.

An additional object of the present invention is to provide a typewriter misprint correction method in which correction tape is fed for each of a multiple of erasing impressions for complete misprint erasure with minimum ink transfer from correction tape to paper.

Other objects and the further scope of applicability of the present invention will become apparent from the detailed description given hereinafter. It should be understood, however, that the detailed description and specific examples, while indicating preferred embodiments of the invention, are given by way of illustration only. Various changes and modifications within the spirit and scope of the invention will become apparent to those skilled in the art from this detailed description.

To achieve the above objects, in an embodiment of the present invention, a prescribed length of correction tape is fed after the initial erasing impression in a typewriter misprint correction method in which a misprint is erased by multiple erasing impressions through correction tape.

To achieve the above objects, in another embodiment of the present invention, assuming that required correction tape feed length for a single character erasure is "P" and that the erasing impression operation is conducted "N" times for a single character, length "P/N" of correction tape is fed before or after each erasing impression, in a typewriter misprint correction method in which misprint ink is lifted by multiple erasing impressions through correction tape.

BRIEF DESCRIPTION OF THE DRAWINGS

The present invention will be better unstood from the detailed description given hereinbelow and the accompanying drawings, which are given by way of illustration only and thus not limitative of the present invention in which.

DETAILED DESCRIPTION OF THE PREFERRED EMBODIMENTS

Figure 1:
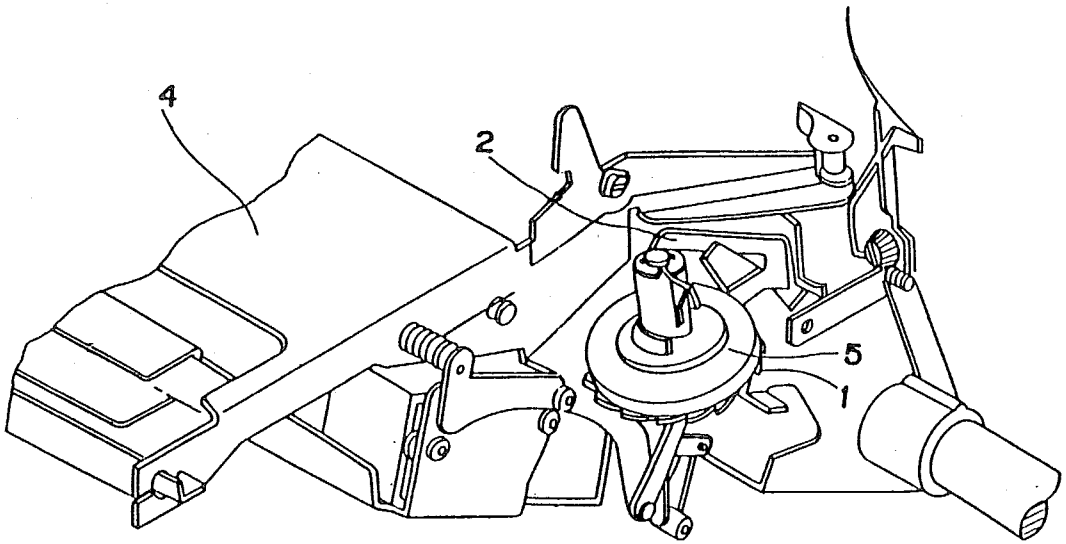
FIG. 1 is a perspective view of a typewriter carriage according to the present invention.

A typewriter carriage related to the present invention is partially shown, in perspective, in FIG. 1.

Figure 2:
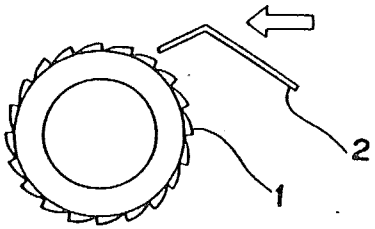
FIG. 2 is a plan view showing a correction tape winding reel sprocket wheel.

Numeral (4) is the shifter. Printing ink ribbon or correction tape is shifted up to printing position by upward movement of the shifter (4). Numeral (5) is a correction tape winding reel under which a sprocket wheel (1) is coaxially mounted, as shown in FIG. 2. The upward shift of the correction tape for the erasing operation actuates a driving lever (2) of the sprocket wheel (1), moving it in the direction indicated by the arrow, causing the sprocket wheel (1) or the correction tape winding reel (5) to rotate to feed the prescribed length of correction tape. In the typewriter related to the present invention in which the correction tape feed operation is correlated with the shift operation as mentioned above, a mechanism is provided to selectively release the correlated correction tape feed operation.

The first embodiment of the invention will be described below with reference to the accompanying drawings.

Figure 3A:
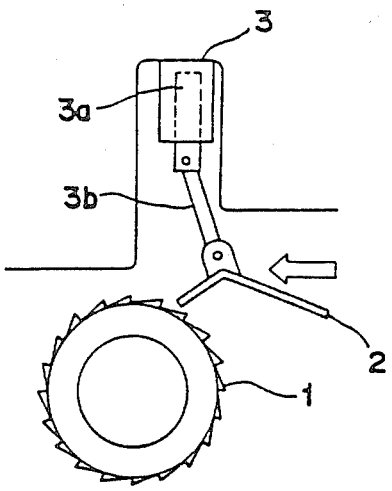
FIGS. 3 (*a*) through 3 (*c*) are plan views showing the sprocket wheel driving mechanism.
Figure 3B:
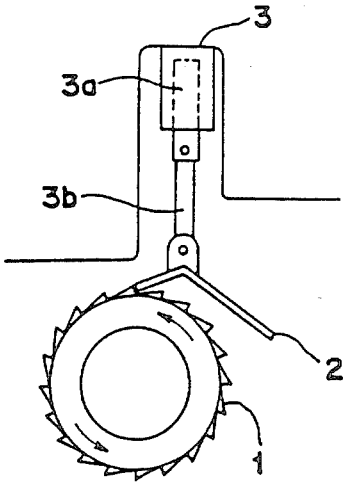
Figure 3C:
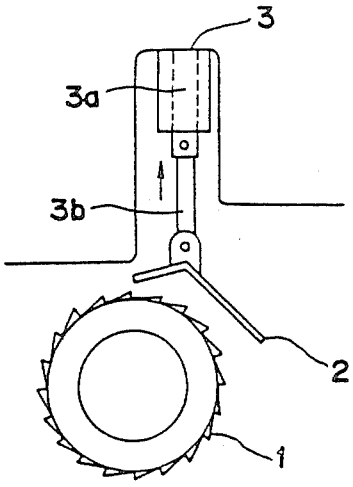

As shown in FIGS. 3 (*a*) through 3 (*c*), a switching solenoid (3) including an electro-magnetic coil is positioned perpendicularly to the driving lever's (2) driving direction, on the opposite side of the sprocket wheel (1). The driving lever (2) is connected through a rotary connecting rod (3*b*) to a switching solenoid cylinder (3*a*). In FIG. 3 (*a*), the correction tape has not shifted up and switching solenoid (3) is turned OFF. In FIG. 3 (*b*), the correction tape is shifted up and driving lever (2) is actuated, turning sprocket wheel (1) for correction tape feed. In FIG. 3 (*c*), correction tape is shifted up and driver lever (2) is driven when switching solenoid (3) is switched on. The driving lever (2), which is moved toward the excited switching solenoid (3), disengages from sprocket wheel (1). As a result, sprocket wheel (1) does not rotate and, therefore, correction tape is not fed.

Thus, actuation of switching solenoid (3) will release correlation between correction tape shift operation and correction tape feed operation.

Figure 4:
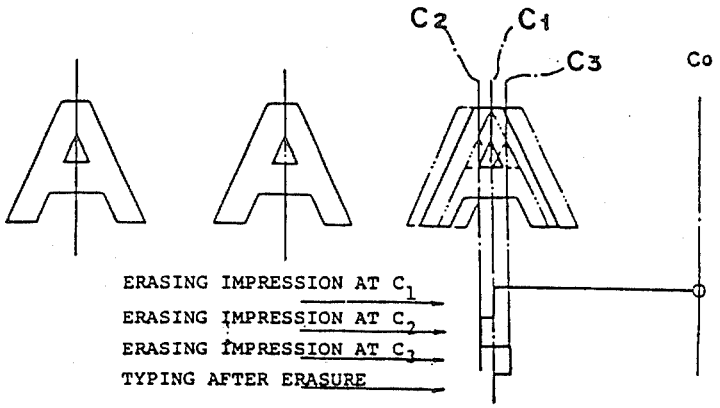
FIG. 4 shows carriage movement for erasing impression.

FIG. 4 shows carriage center positions for three type impression operations for letter "A" erasure. The carriage backspaces from the subsequent printing position "$C_0$" to position "$C_1$", where an erasing impression is conducted, and moves to position "$C_2$" and then to "$C_3$" for additional erasing impressions.

Figure 5:
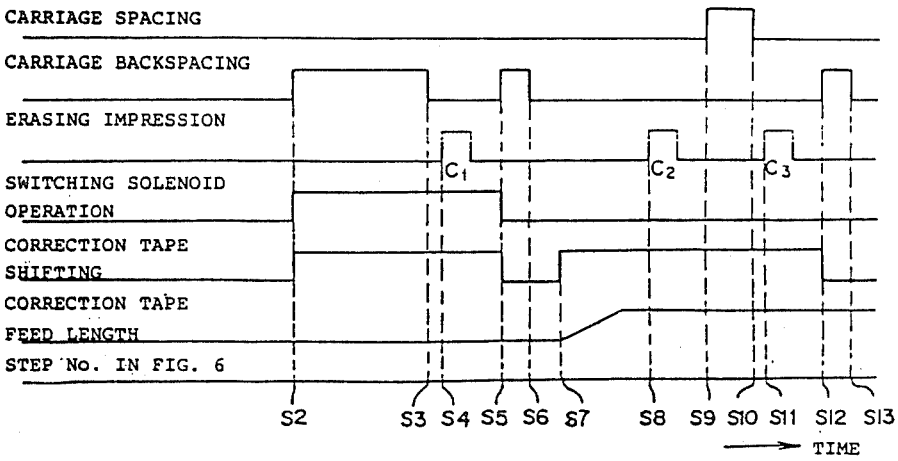
FIG. 5 is an erasing operation time chart for an embodiment of the present invention.
Figure 6:
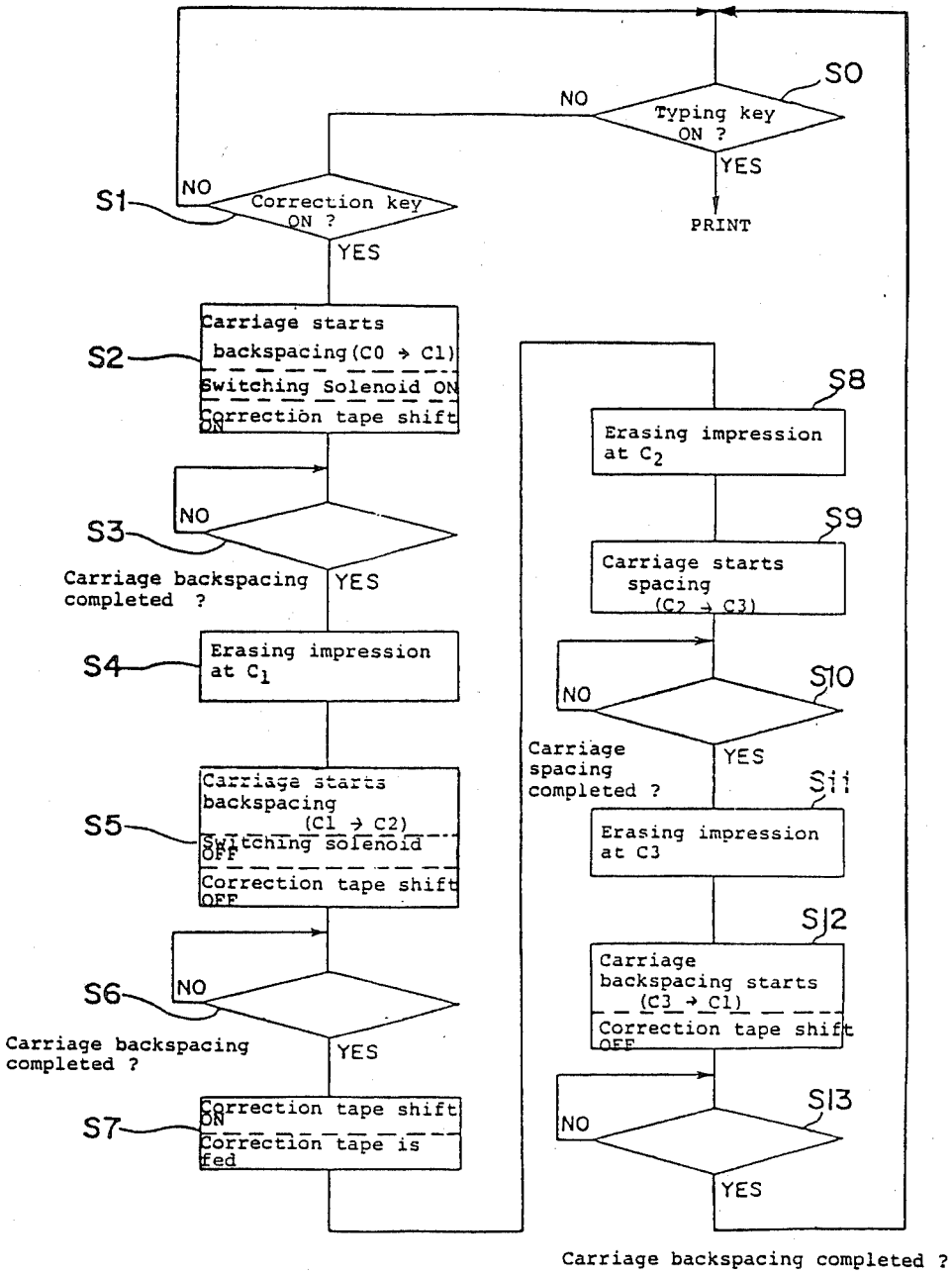
FIG. 6 is a flow chart of the erasing operation in FIG. 5.

The erasing operation will be specifically described with reference to the FIG. 5 time chart and the FIG. 6 flow chart.

When the correction key is depressed at step $S_0$, operation proceeds from step $S_1$ to step $S_2$, where the carriage backspaces from "$C_0$" to "$C_1$". Simultaneously, switching solenoid (3) is turned ON, shifting the correction tape up. At this time the correction tape is not fed due to the switching solenoid (3) actuation. When the above carriage backspacing is completed, operation proceeds from step $S_3$ to step $S_4$, where an erasing impression is conducted at position "$C_1$". In step $S_5$, the carriage further backspaces from "$C_1$" to "$C_2$" and switching solenoid (3) is turned OFF, shifting the correction tape down. When the above carriage backspacing is completed, operation proceeds from step $S_6$ to step $S_7$, where the correction tape is again shifred up. Now that the switching solenoid (3) is OFF, upward shift of the correction tape causes the prescribed length of correction tape to be fed. An erasing impression is conducted at position "$C_2$" in step $S_8$, after which the carriage starts moving from "$C_2$" to "$C_3$" in step $S_9$. When this movement is completed, operation proceeds from step $S_{10}$ to step $S_{11}$, where the final erasing impression is conducted at position "$C_3$". In step $S_{12}$, the carriage starts backspacing from position "$C_3$" to position "$C_1$" and the correction tape is shifted down. When backspacing is completed, operation returns from step $S_{13}$ to initial step $S_0$ and the erasing operation ends.

Thus, correction tape is not fed before the initial erasing impression but after it. The second and the third erasing impressions are conducted using fresh correction tape. Accordingly, correction tape used for the second and the third erasing impressions will be used for the first erasing impression in the subsequent correction operation. It might be anticipated, therefore, that ink adhering to the correction tape from the previous correction operation will be transferred onto the paper in the subsequent correction operation. In fact, only a small portion of a character remains unerased after the first impression and, therefore, only a small amount of ink adheres to the correction tape in the second and third erasing impressions. Ink transfer from correction tape onto paper is therefore negligible. Thus, according to this embodiment of the present invention, character erasing performance is improved without increasing correction tape feed.

As described in detail above, according to this embodiment, a mechanism is provided for selectively feeding correction tape only after the first erasing impression so that second and subsequent erasing impressions are performed with fresh correction tape. Erasing performance can thus be improved without increasing correction tape feed.

In the above embodiment, three erasing impressions are performed, though the number of impressions may be modified as appropriate. Correction tape is fed only once after the first erasing impression in the above embodiment. Alternatively, it may be fed after the second impression or after any subsequent impressions. It may also be fed by a prescribed amount two or more times between erasing impressions.

The second embodiment of the present invention will now be described. According to the second embodiment, the erasing impression is conducted N times for each character and a prescribed length of correction tape is fed for each type impression. Correction tape feed length for each erasing impression is 1/N of the tape length required to erase a single character.

For simplification, the embodiment is described assuming that three erasing impressions are performed for a single character.

Figure 7:
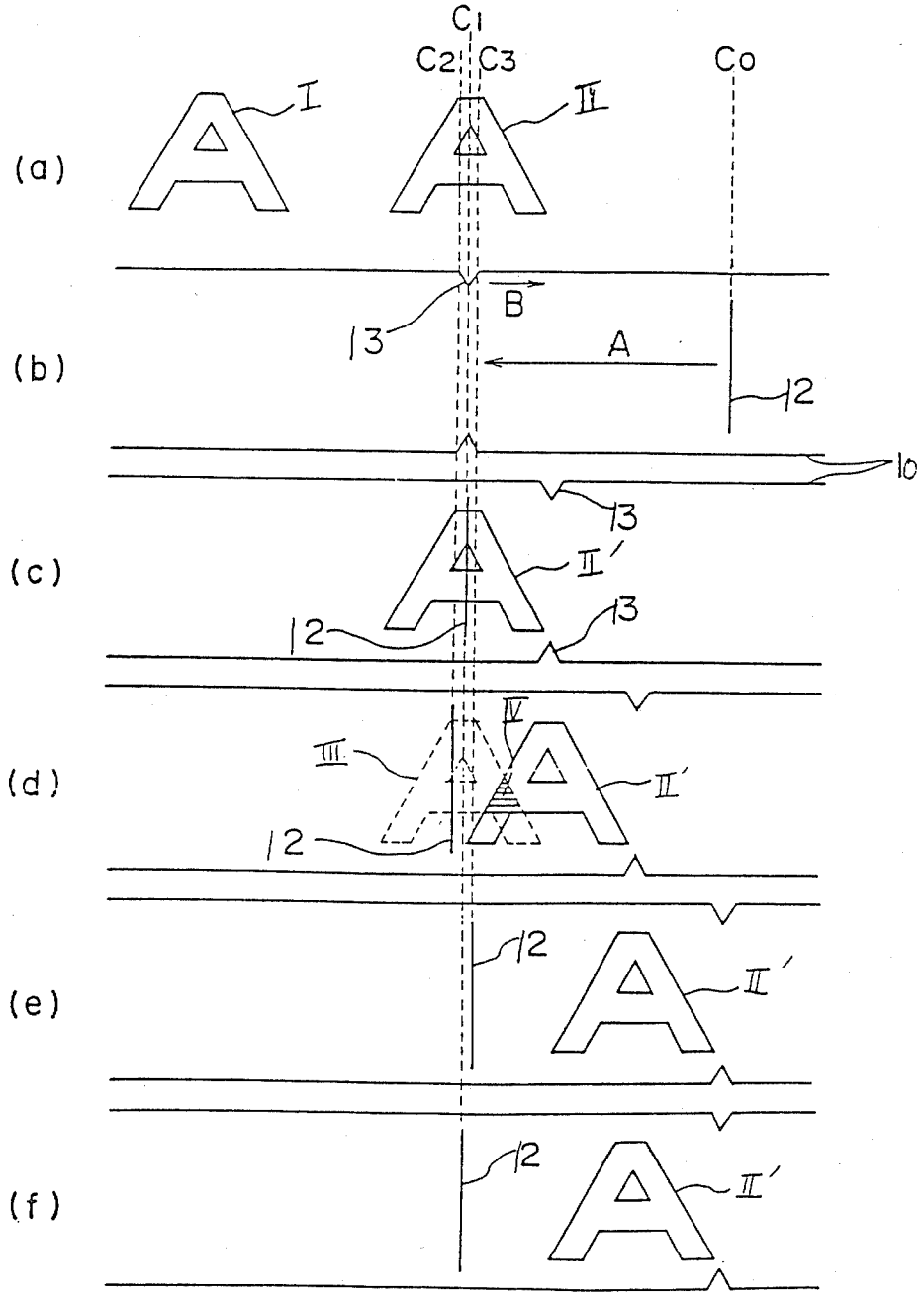
FIG. 7 shows an erasing operation for another embodiment of the invention.

FIG. 7 shows the erasing operation for the second embodiment of the invention, in which three erasing impression are conducted for a single character and correction tape is fed by $\frac{1}{3}$ the conventional tape feed "P" (length required to erase one character) for each erasing impression.

FIG. 7 (*a*) shows characters I and II printed on paper. "$C_0$" indicates the subsequent printing position, namely carriage center position. Referring to FIGS. 7 (*b*) through 7 (*f*), (10) is the correction tape, and (12) is the carriage center position for the printing or the erasing operation. Correction tape (10) is provided with a notch (13) to indicate tape feed length.

FIG. 7 (*b*) shows the carriage center position before the erasing operation. The notch (13) is located at "$C_1$", and carriage center (12) is positioned at "$C_0$". The carriage center (12) backspaces, as indicated by arrow "A", to center position "$C_1$" of character II, and correction tape (10) is shifted up to erasing position, namely misprint position (not shown in FIG. 7). Simultaneously, correction tape (10) is fed by the length P/3 to the right, as indicated by arrow "B". FIG. 7 (*c*) shows conditions after the first erasing impression has been made, with the ink (indicated by II') from character II adhering to the correction tape. The carriage then backspaces to position "$C_2$" for the second erasing impression. FIG. 7 (*d*) shows correction tape (10) being fed to the right. The character shown in dotted line, identified by III, indicates unerased character II under correction tape (10). In this state, the second erasing impression is conducted. In this impression, only the ink portion IV at the intersection of the characters II' and III may be transferred from correction tape (10) onto the paper.

In FIG. 7 (*e*), carriage center (12) moves (for spacing) to position "$C_3$" for the third erasing impression and correction tape (10) is fed by an additional length P/3 to the right. In FIG. 7 (*f*), the carriage center (12) backspaces to position "$C_1$". For further erasing of character I, the steps shown in FIGS. 7 (*b*) through 7 (*f*) may be repeated.

Figure 8:
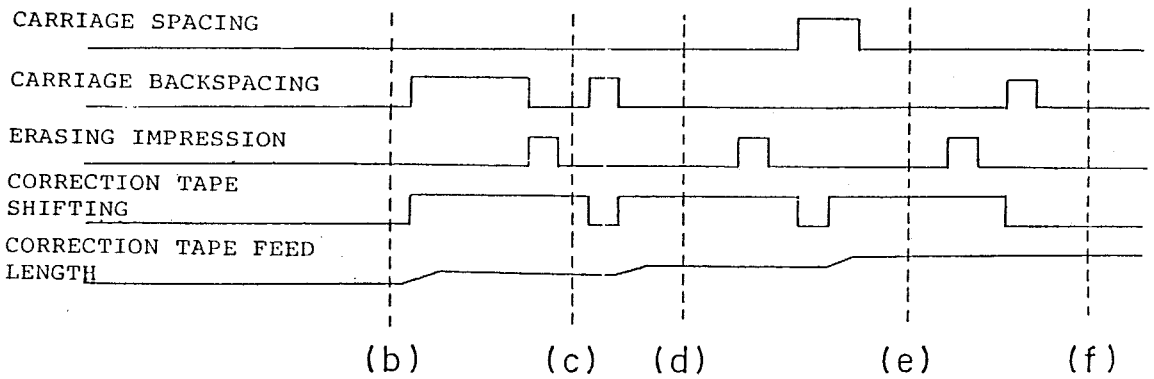
FIG. 8 is a time chart of the erasing operation in FIG. 7.

FIG. 8 is an erasing operation time chart in which the timing of each operation step (b) through (f) shown in FIG. 7 is marked.

In this embodiment, correction tape is shifted up and fed for each erasing impression. Sprocket wheel **(2*a*)** has three times as many teeth as the conventional sprocket wheel but has the same diameter; thus correction tape is fed by $\frac{1}{3}$ the conventional feed length (required to erase a character) for each erasing impression.

Accordingly, only a small ink portion, if any, is transferred from the correction tape onto the paper in the second erasing impression. If a small ink portion is transferred onto the paper it can be completely erased by the third type impression. In the present invention, correction tape winding reel (5) rotates at a constant rate when feeding correction tape. In such a tape-feeding method, correction tape winding reel diameter increases as correction tape is fed and wound. Thus correction tape feed length increases with reel diameter increase. Accordingly, the ink area of intersection IV which can be transferred onto the paper tends to reduce over time. Moveover, some characters such as "!", ":", "(" and "/" produce no intersections.

As described in detail in the above, according to the second embodiment of the invention, erasing impression is conducted "N" times for each character and correction tape is fed by 1/N the total correction tape feed length "P" (required to erase a single character) for each erasing impression. The ink area transferred from the correction tape onto the paper is thus minimized, resulting in complete erasure of a given misprint using the same correction tape feed length required in the conventional method.

According to the present invention, as understood from the above description, the erasing impression is made two or more times for a single character and correction tape is fed by a prescribed length after (or before) at least one erasing impression for complete misprint erasure.

While only certain embodiments of the present invention have been described, it will be apparent to those skilled in the art that various changes and modifications may be made therein without departing from the spirit and scope of the present invention as claimed.

What is claimed is:

1. A typewriter misprint correction method for a typewriter having a movable carriage in which a misprint is completely erased when ink is lifted from the paper by an erasing impression through a correction tape comprising:

positioning said movable carriage over the center of said misprint;

making said erasing impression through said correction tape and adjusting the position of said movable carriage to overlap a part of said misprint, said erasing impression being conducted two or more times for said misprint; and feeding a prescribed length of correction tape after at least one erasing impression has been made, said step of feeding supplying a total length of said correction tape used in erasing said misprint which is less than or equal to the width of one character position, said step of feeding a prescribed length of correction tape is determined by feeding said correction tape a length "P/N" before or after each erasing impression, wherein the correction tape feed length required for erasing a single character is "P" and the number of erasing impressions for a single character is "N".

2. A typewriter misprint correction method as recited in claim 1, wherein said step of feeding a prescribed length of correction tape is performed after a first erasing impression with no feeding of said correction tape after subsequent erasing impressions for the same misprint.

3. A method of removing misprinted characters in an impact character printing apparatus comprising:

positioning an adhesive correction tape between the misprinted character to be removed and a character impact key which produced said misprinted character;

subsequently performing the steps of, striking said adhesive correction tape and misprinted character with said character impact key, advancing said adhesive correction tape a predetermined increment, and shifting said character impact key;

said steps of striking, advancing, and shifting being performed N times, where N is an integer of 2 or greater;

said predetermined increment being sized to 1/N of the width of said misprinted character.

4. A method, as recited in claim 3, wherein said step of shifting is performed by advancing said character impact key by an equally spaced increment for each of the performances of said steps of striking, advancing and shifting so that the entire area of said misprinted character will be struck by said character impact key over said N steps of striking.

5. A method, as recited in claim 3, wherein N is an integer of 3 or greater.

6. A method, as recited in claim 3, wherein said step of striking is first performed with said character impact key being positioned over the center of said misprinted character and said step of shifting is performed by moving said impact character key to a position which overlaps but is slightly offset from the center of said misprinted character.

* * * * *